US007891020B2

(12) United States Patent
Von Blücher

(10) Patent No.: US 7,891,020 B2
(45) Date of Patent: Feb. 22, 2011

(54) FUNCTIONAL APPAREL ITEM, IN PARTICULAR NBC PROTECTIVE APPAREL WITH INTEGRATED MEASURING APPLIANCE

(75) Inventor: Hasso Von Blücher, Erkrath (DE)

(73) Assignee: Blucher GmbH, Erkrath (DE)

( * ) Notice: Subject to any disclaimer, the term of this patent is extended or adjusted under 35 U.S.C. 154(b) by 80 days.

(21) Appl. No.: 11/635,093

(22) Filed: Dec. 7, 2006

(65) Prior Publication Data

US 2007/0130676 A1 Jun. 14, 2007

(30) Foreign Application Priority Data

Dec. 8, 2005 (DE) ..... 10 2005 059 013
Feb. 3, 2006 (DE) ..... 10 2006 004 946

(51) Int. Cl.
*A41D 13/00* (2006.01)

(52) U.S. Cl. ..... 2/69

(58) Field of Classification Search ..... 340/602, 340/573.1; 2/456, 457, 69, 69.5, 102, 108
See application file for complete search history.

(56) References Cited

U.S. PATENT DOCUMENTS 4,599,609 A * 7/1986 Blanchard ..... 340/602
4,734,072 A 3/1988 Lastnik
4,843,014 A 6/1989 Cukier
5,061,636 A * 10/1991 Thoraval et al. ..... 436/104
5,493,730 A * 2/1996 Vo-Dinh ..... 2/457
5,635,909 A 6/1997 Cole
6,080,690 A 6/2000 Lebby
6,267,232 B1 * 7/2001 LeJeune ..... 206/213
6,388,422 B1 5/2002 Lew
6,767,509 B1 * 7/2004 Griesbach et al. ..... 422/29
2003/0214408 A1 11/2003 Grajales et al.
2004/0009729 A1 1/2004 Hill et al.

FOREIGN PATENT DOCUMENTS

DE 197 49 862 A1 5/1999
DE 101 55 935 A1 5/2003
DE 203 08 642 U1 7/2004
DE 103 11 185 A1 9/2004
DE 103 50 869 A1 6/2005
DE 103 57 193 A1 7/2005
WO WO 00/62633 A 10/2000
WO WO 2004/073798 A 9/2004

* cited by examiner

*Primary Examiner*—Tejash Patel
(74) *Attorney, Agent, or Firm*—Woodard, Emhardt, Moriarty, McNett & Henry LLP

(57) ABSTRACT

The invention concerns a functional apparel item, in particular protective apparel having a protective function against biological and/or chemical toxicant or noxiant materials, the apparel item being equipped with a measuring appliance capturing at least one measurable quantity and adapted for determining the serviceability of the apparel item.

9 Claims, 3 Drawing Sheets

FUNCTIONAL APPAREL ITEM, IN PARTICULAR NBC PROTECTIVE APPAREL WITH INTEGRATED MEASURING APPLIANCE

CROSS REFERENCES TO RELATED APPLICATIONS

This application claims priority to German Patent Application No. DE 10 2005 059 013.6, filed Dec. 8, 2005, and also claims priority to German Patent Application No. DE 10 2006 004 946.2, filed Feb. 3, 2006, entitled "FUNCTIONAL APPAREL ITEM, IN PARTICULAR NBC PROTECTIVE APPAREL WITH INTEGRATED MEASURING APPLIANCE". Both references are expressly incorporated by reference herein, in their entirety.

BACKGROUND OF THE INVENTION

The present invention relates to a functional apparel item incorporating the use of a measuring appliance (i.e. a method of using a measuring appliance) and to a process for determining the serviceability of a functional apparel item.

There are a host of materials which on contact with the human body are absorbed by the skin, potentially leading to serious physical harm (noxae). Examples are chemical toxicant and noxiant materials, in particular chemical warfare agents, for example the vesicatory mustard gas (Hd, Yellow Cross) and the nerve gas sarin. People liable to come into contact with such highly toxic materials have to wear suitable protective equipment or be protected against these toxic substances by suitable protective materials.

Appropriate protective suits are available to protect the body, in particular the extremities and the trunk. The head, in particular the face and also the respiratory tract pathways, are generally protected by wearing NBC protective masks with or without hoods.

To achieve effective protection against the aforementioned toxic substances, NBC protective apparel is traditionally made either from completely impermeable systems (examples being suits made of butyl rubber) or else permeable adsorptive filtering systems based on activated carbon (powder, fibers or spherocarbon). Protective suits against chemical poisons that are intended for prolonged use under a wide variety of conditions must not lead to any significant heat build-up for the wearer. Air-pervious materials are therefore used in the main. Air-pervious, permeable protective suits generally possess an adsorbing layer of activated carbon which binds the chemical poisons very durably, so that even badly contaminated suits do not represent any danger whatsoever to the wearer. The great advantage of this system is that the activated carbon is also available on the inside surface, so that poisons that have penetrated at damaged or otherwise leaky locations are very rapidly adsorbed.

In principle, however, it is disadvantageous that such protective apparels generally possess a time-limited serviceability or durability. The reason for this is that the protective apparel becomes contaminated or polluted with toxicant or noxiant materials in the course of a deployment for example, and this may also lead inter alia to any adsorbing materials present in the protective apparel becoming saturated. In the extreme case of severe contamination or pollution of the protective apparel, adequate protection of the wearer from the toxicant or noxiant materials in question is no longer completely ensured. In addition, ageing processes play a great part with regard to the utility of protective apparel. For instance washing operations, decontamination measures, but also wearing or deployment times for the protective apparel, the action of chemical substances and the like lead to a significant decrease in the quality of the material and thus to a limited wearing time.

To counteract ageing processes, prior art protective apparel is stored for example in sealed, i.e. airtight, in particular depressurized, secondary packaging.

Especially against the background that a wearer of the protective apparel may occasionally be exposed to materials, such as chemical toxicant and/or warfare agent materials, that are highly toxic and fatal in small doses, ensuring effective protection by the protective apparel is extremely important to avoid noxae to the wearer of the protective apparel. Against this background, it is very important to be able to make a statement about the fitness for purpose or serviceability of the protective apparel, in particular when the protective apparel has been stored for a prolonged period or has just been used.

However, such a determination of the fitness for purpose or serviceability of the protective apparel is often associated with immense difficulties, since time- and cost-intensive analyses of the protective material to be investigated have to be undertaken in this regard. This applies in particular in the field—for example in the course of a military deployment—since a large number of protective apparels have to be investigated or analyzed under highly adverse conditions. A quick and informative determination of parameters characterizing the serviceability of protective apparel is often not possible in this context.

In addition, there is also immense interest in obtaining information about the serviceability of protective apparel as a function of the time since removal of the protective apparel from the secondary packaging or of the number of washing or decontaminating operations, the wearing time and the degree of contamination. However, this cannot be done quickly and simply using prior art means. In addition, the serviceability of protective apparel shall also be assessable with reference to its storage. Serviceability can be appreciably worse when the protective apparel has been defectively stored for example too warm, too moist or in non-airtight secondary packaging.

Against this background, then, the present invention has for its object to provide a functional apparel item, such as a protective apparel, that at least partially obviates or at least ameliorates the above-described disadvantages of the prior art. More particularly, there is to be provided a functional apparel item whose serviceability can be quickly and simply determined or evaluated even under adverse conditions.

By way of achievement to the object stated above, the present invention proposes a functional apparel item, in particular a protective apparel having a protective function against biological or chemical toxicant or noxiant materials. Further, advantageous embodiments are the subject of additional embodiments of invention.

The present invention further provides for the use of a measuring appliance capturing at least one measurable quantity (i.e. to the method of using a measuring appliance capturing at least one measurable quantity).

The present invention finally provides a process for determining the serviceability of a functional apparel item.

A first aspect of the present invention is thus a specifically equipped, functional apparel item, in particular a protective apparel having a protective function against biological or chemical toxicant or noxiant materials.

One particular feature of the present invention's functional apparel item is that the apparel item is equipped with at least one measuring appliance. The measuring appliance is such that it is capable of capturing at least one measurable quantity, for example a defined environmental factor, and thus can be used for determining the serviceability of the apparel item. It is thus one central idea of the present invention that a functional apparel item is equipped with a measuring appliance which captures at least one measurable quantity and with reference to which the serviceability of the apparel item can be quickly and simply determined. Owing to the use of a specific measuring appliance, a rapid and reliable statement about the serviceability of the present invention's functional apparel item can thus be made directly on the spot, for example while still in the packed state or after removal of the apparel item from the secondary packaging or in the field.

It is particularly possible in the realm of the present invention to so to speak custom-tailor the measuring appliance in relation to the measurable quantity to be captured, so that for example specifically temperature, pressure, moisture, radiation, pH measurable quantities and/or a measurable quantity resulting from and or induced by the presence of a chemical substance, for example of a biological or chemical toxicant or noxiant material, are capturable. This must be viewed as a further key idea of the present invention.

The present invention thus represents the first successful making available of an apparel item comprising a measuring appliance configured for specific determination of the serviceability of the functional apparel item according to the invention. Such a principle has hitherto not been known in the art. True, there is prior art where garments in particular are equipped with electronic components, but these are not intended for specific determination of serviceability.

DE 103 50 869 A1 describes a garment with integrated electronic components selected from sensors, actuators, electronic switching units, memory components and antennas. However, the sensors used in this document merely serve to determine the posture or movements of a wearer of the garment and the garment is chiefly to be used in the sports sector to optimize movement sequences. Furthermore, DE 103 57 193 A1 concerns an electronic label for textiles whose transponder arrangement is completely embedded in adhesive, the label being exclusively designed for storing and transmitting data concerning the textile. Furthermore, DE 103 11 185 A1 concerns a label for identifying textiles which is contactlessly readable by means of radio waves. The label serves exclusively to store information items about the corresponding textile, such as laundering instructions. Finally, DE 101 55 935 A1 concerns a smart label for textiles to store data which comprises a textile backing and a flexible wire or a threadlike electric conductor comprising at least a connecting point for an electronic component.

Further advantages, features, properties and aspects of the present invention will become apparent from the following description of preferred embodiments based on the accompanying figures, where:

BRIEF SUMMARY

A functional apparel item is disclosed, in particular protective apparel having a protective function against biological and chemical toxicant or noxiant materials, wherein the apparel item is equipped with a measuring appliance capturing at least one measurable quantity and adapted for determining the serviceability of the apparel item.

One object of the present disclosure is to provide an improved protective item of apparel which includes a measuring appliance.

DETAILED DESCRIPTION

Figure 1A:
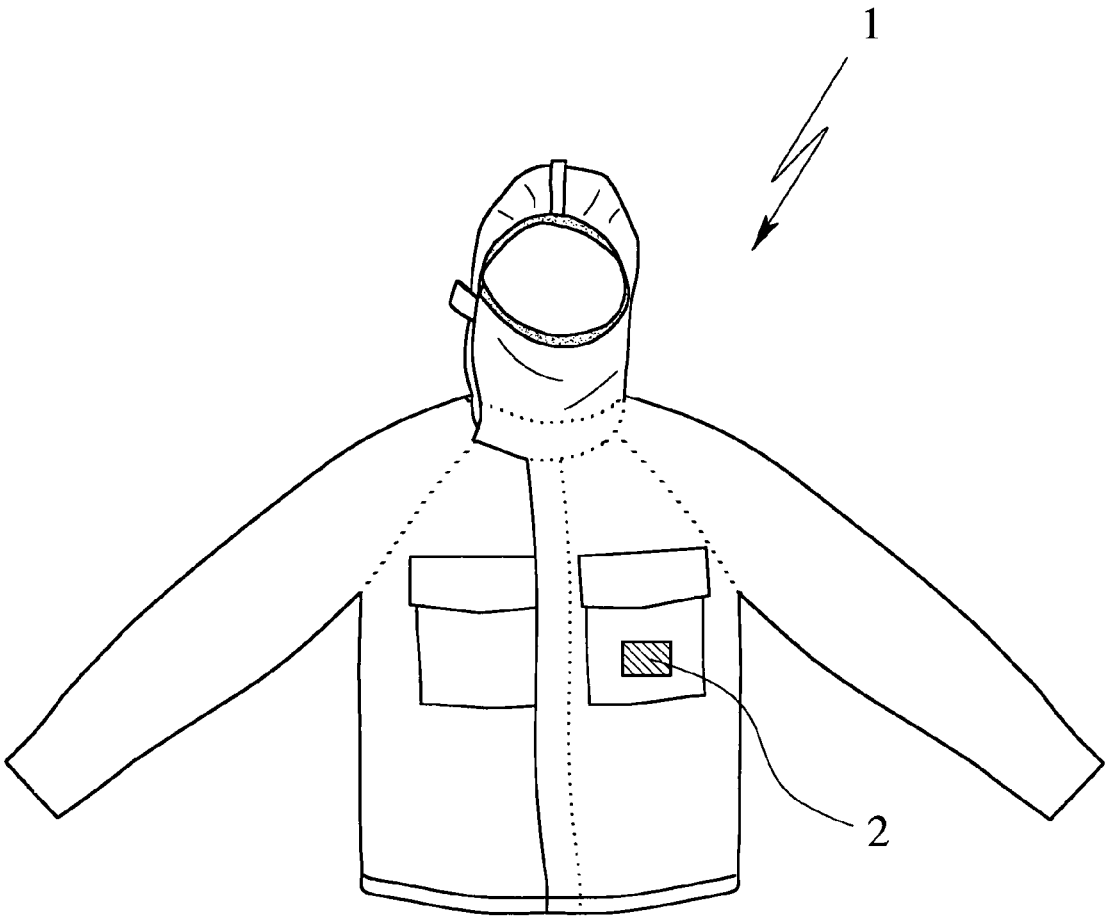
FIG. 1A shows a view of a present invention's functional apparel item in the form of a jacket, the jacket being equipped with a measuring appliance.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

In the figures, the same reference symbols are used for the same or similar parts, and corresponding properties and advantages are achieved even though repeated description is omitted for simplicity.

Figure 1B:
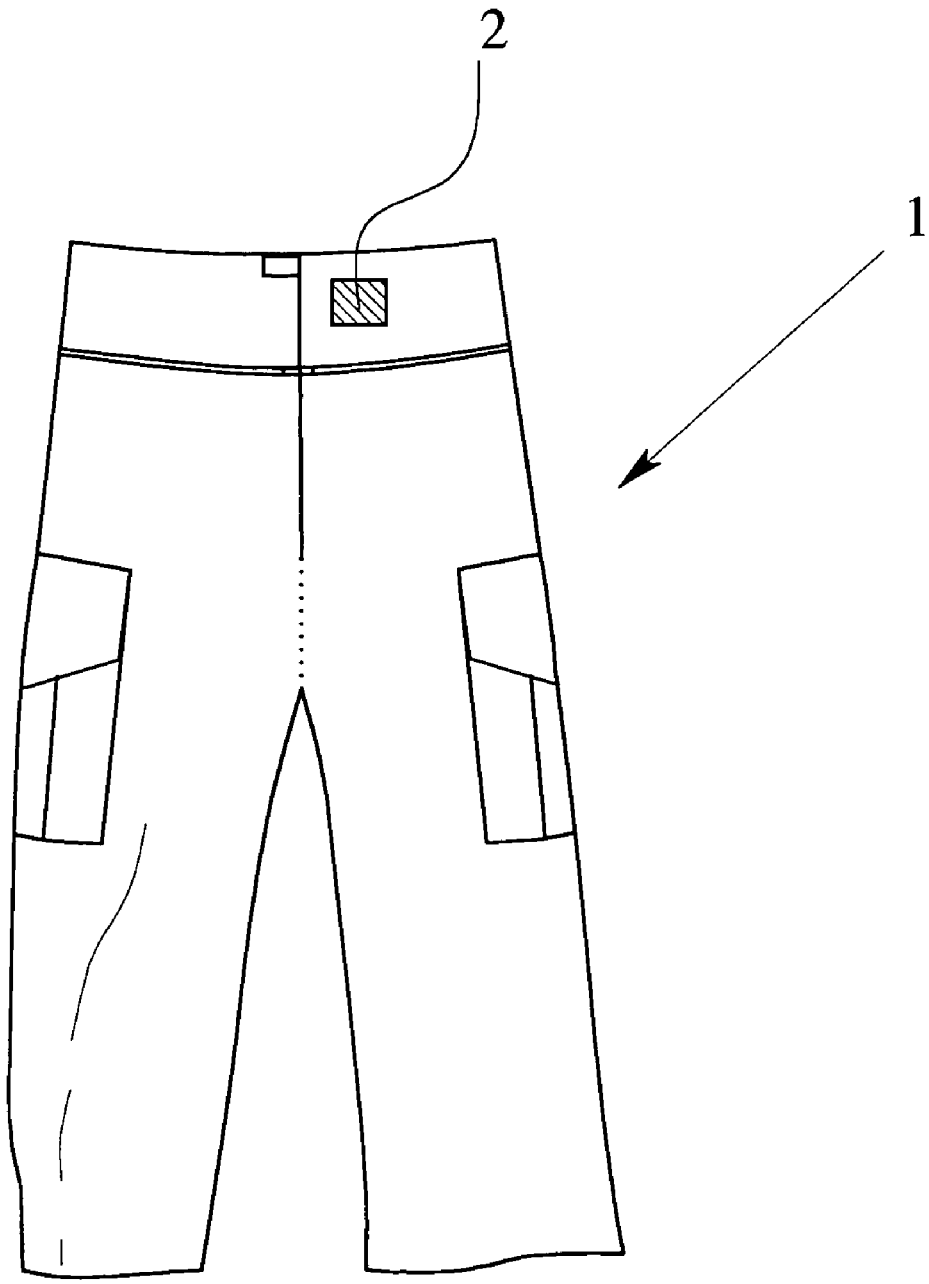
FIG. 1B shows a view of a further present invention's functional apparel item in the form of a pair of trousers, the trousers being equipped with a measuring appliance.

FIGS. 1A and 1B each show a present invention's functional apparel item 1, in particular a protective apparel having a protective function against biological or chemical toxicant or noxiant materials, for example biological or chemical warfare agents. FIG. 1A shows by way of example a present invention's embodiment wherein the functional apparel item 1 is constructed in accordance with the present invention as a jacket which in the present case is additionally equipped with a hood to protect the head. FIG. 1B reveals a further present invention embodiment wherein the present invention's functional apparel item 1 is constructed as a pair of trousers. The present invention's functional apparel item 1, however, is in no way restricted to the aforementioned embodiments. On the contrary, the functional apparel item 1 can be constructed as protective apparel of any kind, such as NBC protective apparel useful in the civilian as well as in the military sector. The present invention's apparel item 1 may be constructed as a suit or overall, as a hood, as a glove, as a shoe, as an item of underwear, such as a vest or undershirt, a pair of underpants or briefs, a sock and the like.

As FIGS. 1A and 1B further show, the present invention's apparel item 1 is in accordance with the present invention equipped with a measuring appliance 2 which captures at least one measurable quantity and is adapted to determine the serviceability of the present invention's apparel item 1.

As regards the term "serviceability" which is used herein—synonymously also referred to as fitness for purpose or durability in the realm of the present invention—it is to be understood as referring to the fitness for purpose or use of the present invention's apparel item 1 with particular regard to the protective function against biological or chemical toxicant and/or noxiant materials. In other words, a protective apparel is herein to be regarded as "serviceable" if it offers at least essentially complete protection against biological or chemical toxicant or noxiant materials. As stated above, the serviceability or fitness for purpose of a protective apparel or of the present invention's functional apparel item 1 is influenced by numerous factors. These factors include for example the storage time of the present invention's apparel item 1, the number of washing or decontaminating operations, the wear time, the deployment type and duration (for example military deployment in the field), the wear time and also the time of removal from the secondary packaging.

The measurable quantity captured by the measuring appliance 2 used according to the present invention is a measurable quantity that influences the serviceability of the present invention's apparel item 1. The measurable quantity may be for example a physical or chemical measurable quantity, but also a biochemical or biological measurable quantity.

The measurable quantity may be a temperature, pressure, moisture, radiation or pH measurable quantity. In accordance with an embodiment which is preferred according to the present invention, the measurable quantity is a measurable quantity resulting from and/or induced by the presence of a chemical substance, as of a biological or chemical toxicant and/or noxiant material.

The measurable quantity captured by the measuring appliance 2 is thus so to speak an ambient or environmental factor which acts on the present invention's functional apparel item 1 and which influences in particular the serviceability of the present invention's functional apparel item 1. By way of example and nonlimitingly, high ambient temperatures, moisture and also certain radiative exposures, for example UV radiation, induce certain ageing processes which can lead to a reduction in the protective function offered by the apparel item 1. For instance, the apparel item 1 may become porous or brittle. Similarly, chemical factors, for example a high alkalinity during washing or acidity during decontamination, have an appreciable influence on serviceability.

Moreover, the serviceability of the present invention's functional apparel item 1 is significantly influenced to a particular degree by certain chemical substances, such as biological or chemical toxicant or noxiant materials. For instance, an excessively contaminated protective apparel may experience for example a certain saturation of any adsorptive or adsorbing layer present.

Similarly, the measurable quantity to be captured may also be radioactive radiation, electromagnetic radiation or particle radiation. This is because these ambient or environmental factors likewise influence the serviceability of apparel item 1.

The measurable quantities described above are captured by qualitative and/or quantitative measuring technology. In the realm of the present invention, the measurable quantity or quantities is or are capturable with regard to their duration, i.e. the length of time the measurable quantity or quantities acts or act, their intensity, i.e. the degree or strength of the measurable quantity or quantities acting on the apparel item 1, and/or their frequency, i.e. the interval between the occurrence of measurable quantities or the frequency of the measurable quantity or quantities which occur within a defined period of time.

Figure 2:
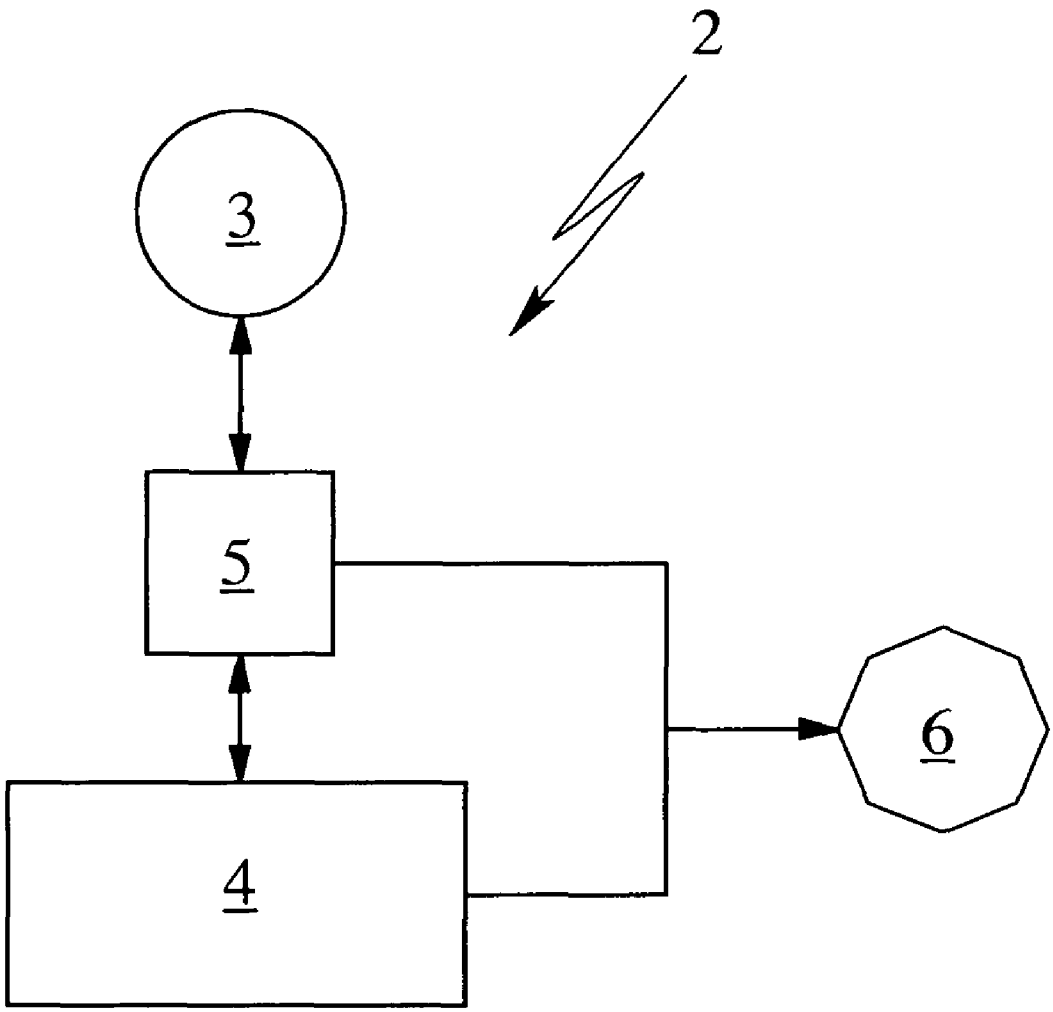
FIG. 2 shows a schematic representation of a measuring appliance consisting of a plurality of components.

FIG. 2 shows that the measuring appliance 2 used for the present invention's functional apparel item 1 preferably comprises a sensor 3.

According to the present invention, the term "sensor" is to be understood as meaning a structural element which captures physical, chemical or electrochemical measurable quantities and converts them into a measurement signal. Preferably, the sensor 3 used according to the present invention comprises an electrical or electronic structural element wherein the measurable quantity is converted with sufficient accuracy into an electrical measurement signal. Preferably, the sensor 3 is the first member of the measuring appliance 2 used according to the present invention.

In this regard, the sensor 3 may be a temperature sensor, a pressure sensor, a moisture sensor, a radiation or particle sensor or else a sensor for electromagnetic radiation, a pH sensor and/or a sensor having preferably specific sensitivity to a chemical substance, in particular a biological or chemical toxicant or warfare agent material.

Useful temperature sensors for the present invention include for example thermistor or posistor temperature sensors. Useful pressure sensors in the realm of the present invention include for example barometric pressure sensors, ceramic pressure sensors and also silicon-based pressure sensors. It is similarly within the realm of the present invention to use a moisture sensor comprising a moisture sensor having moisture content dependent sensitivity, in particular conductivity. In accordance with the present invention, a radioactivity sensor can be used as radiation or particle sensor. The aforementioned examples are in no way limiting and one skilled in the art will always be able to select appropriate sensors for capturing a measurable quantity influencing or characterizing the serviceability of the present invention's functional apparel item 1.

The measuring appliance 2 used according to the present invention may further be equipped with a plurality of sensors 3, for which sensors 3 of the aforementioned kind each having different specificities can be used. It is possible by way of example and without any limitation being applied to equip the measuring appliance 2 with two, three, four or more sensors 3, for example with a temperature sensor, a pressure sensor and a moisture sensor.

In accordance with one embodiment of the present invention, the sensor 3 is a physical, chemical or biochemical sensor 3, in which case the sensor 3 induces or exhibits as a consequence of the capture of the measurable quantity a measurement signal induced in particular by a physical, chemical or biochemical reaction, respectively. The measurement signal may be in particular and nonlimitingly a color change. In this case, the measurement signal may be evaluated for example directly through visual inspection, or else be digitized through an appropriate electronic circuit. The measurement signal thus digitized can subsequently be subjected to a qualitative or quantitative evaluation.

In accordance with a further embodiment preferred according to the present invention, the sensor 3 is an electrical sensor, preferably an electronic sensor. In this case, the sensor 3 transforms the captured measurable quantity—as previously described—into a preferably electrical measurement signal which correlates with the measurable quantity. The preferably electrical measurement signal correlating with the measurable quantity is preferably readable from the sensor 3, so that the measurement signal is available for further processing or evaluation. In other words, the sensor 3 thus captures measurable quantities and transforms them into an appropriate, preferably electrical measurement signal. For instance, a measurable quantity registered by the sensor 3 as a defined temperature can be emitted as resulting measurement signal in the form of an electrical voltage which correlates with this temperature.

The measuring appliance 2 used for the present invention's functional apparel item 1 may comprise a storage unit 4, as further discernible from FIG. 2. The storage unit 4 serves the preferably electronic storage of a measurement signal which correlates with the measurable quantity and which is preferably emitted by the above-described sensor 3. To record or store the measurement signal, the storage unit 4 can be coupled with the sensor 3 directly or indirectly, the coupling preferably being an electrical coupling.

The storage unit 4 preferably comprises a semiconductor memory. The measurement signals are stored in the storage unit 4, in particular for later evaluation or reading. More particularly, the storage unit 4 stores a multiplicity of measurement signals which can be coupled for example with other values, such as the time of detection and the like, so that pairs of values result from the measurement signal and a value assigned to this measurement signal. Preferably, the storage unit 4 stores a multiplicity of measurement signals which—as will be described hereinbelow—can be processed before or after being stored. According to the present invention, it is possible that the storage unit 4 is, for example in the form of IC building blocks, integrated in the sensor 3 or in a hereinbelow described electronic circuit 5 or a read-out unit 6. The storage unit 4 may comprise its own supply of electric current or, for example, be supplied with energy via other components of the measuring appliance 2.

FIG. 2 shows that the measuring appliance 2 used for the present invention's functional apparel item 1 further comprises an electronic circuit 5. The electronic circuit 5 serves in particular to process a measurement signal correlating with the captured measurable quantity. The electronic circuit 5 may in this regard be designed for example such that it transforms an analogue measurement signal emittable by the measuring sensor into a digital measurement signal. Furthermore, the electronic circuit 5 may transmit the processed or unprocessed measurement signal to the storage unit 4 for the purpose of data storage. It is similarly possible according to the present invention for the electronic circuit 5 to pass the measurement signal directly to a read-out unit 6, in particular as hereinbelow described. It is similarly within the realm of the present invention for the electronic circuit 5 to be designed such that it exerts a control function with regard to the sensor 3. It is possible for instance for the electronic circuit 5 to control or regulate for example the sensitivity of the sensor 3 in order that a certain adaptation to measurable quantities arising may be made possible. The electronic circuit 5 may similarly function as an amplifier with regard to the measurable quantity.

According to an embodiment preferred according to the present invention, the electronic circuit 5—as FIG. 2 shows—is coupled with the sensor 3, in particular as defined above, and with the storage unit 4, in particular as defined above, in particular electrically. In accordance with this embodiment, the electronic circuit 5 can emit to the storage unit 4 a measurement signal correlating with the measurable quantity captured by the sensor 3.

But it is also possible for the electronic circuit 5 to read out a measurement signal stored in the storage unit 4, correlating with a measurable quantity and processed or unprocessed, and for example forward it to the hereinbelow described read-out unit 6 for the purpose of further data processing or for the reading out of measurement signals.

FIG. 2 further reveals that the measuring appliance 2 used for the present invention's apparel item 1 may further comprise a read-out unit 6. The read-out unit 6 may be coupled, in particular electrically coupled, with the above-described sensor 3 and/or with the above-described storage unit 4 and/or with the above-described electronic circuit 5. The read-out unit 6 serves as it were to read out measurement signals using a reading instrument for example, so that the measurement signals can be subjected to further data processing, for example by means of an external computer. In this way, the measurement signals which correlate with a measurable quantity which influences or characterizes the serviceability of the present invention's apparel item 1 can be used for a statement with regard to the serviceability of the present invention's apparel item 1, and electronic evaluation being effectable in this context for example such that an indication is provided on the basis of the determined measurement signals as to whether the present invention's apparel item 1 is in a serviceable state. Similarly, the determined and read-out measurement signals may form the basis for a graduated assessment of serviceability, for example for a qualitative and/or quantitative statement with regard to the degree of contamination for example, so that it is possible to determine what residual adsorptive or adsorbing capacity there is with regard to the present invention's apparel item 1.

The read-out unit 6 can function as a transmitter, in which case the measurement signals to be read out can be received by an external receiver and fed to the further external data processing system or display.

Thus, the read-out unit 6 provides in readable form a measurement signal correlating with a measurable quantity. The measurement signal can be transmitted from the storage unit 4 to the read-out unit 6 for example directly or else via the electronic circuit 5, emanating for example from the sensor 3 or from the storage unit 4.

In accordance with an embodiment preferred according to the present invention, the read-out unit 6 may comprise an antenna for preferably contactless read-out of measurement signals. This makes it possible to receive the measurement signals by means of a wireless receiver for example, which constitutes a simple and secure form of data transmission, which is simple to carry out in a military area of deployment for example. In this case the data are read out of the measuring appliance by means of a wireless transmission.

It may further be provided in accordance with the present invention for the measuring appliance 2 used for the present invention's apparel item 1 to equally comprise an energy source for one or more constituents of the measuring appliance 2, as of the sensor 3, of the storage unit 4, of the electronic circuit 5 and also of the read-out unit 6. The energy source preferably comprises a battery, such as a button cell, or correspondingly a rechargeable accumulator.

The measuring appliance 2 used according to the present invention or its above-described components may be accommodated in a housing, which may be a rigid housing or else a flexible housing. It is similarly possible for individual components to be located outside this housing. For example, the sensor 3 may be positioned outside the housing. If the sensor 3 is positioned in the housing, it should be ensured that the capturing or detecting unit of the sensor 3 has a connection to the medium comprising the measurable quantity to be captured, as can be realized for example through a perforation at the appropriate position of the housing. It is similarly possible for one or more constituents of the measuring appliance 2 to be embedded or potted in an adhesive or in a resin.

In accordance with the present invention, the measuring appliance 2 may comprise a well-known radio frequency identification (RF-ID) unit. The RF-ID unit may comprise a transponder, also known by the synonyms of RF-ID label, tag or radiolabel, and also a transmitting/receiving unit as reader. The principle of RF-ID units rests on the measurement signals being initially stored and made available by means of radio waves. The RF-ID unit may be coupled with the sensor 3, in particular electrically.

In accordance with an embodiment preferred according to the present invention, the measuring appliance 2 used for the apparel item 1 is such that it captures the number of washing operations of the present invention's apparel item 1 via a measurable quantity characteristic for the washing operations. The measuring appliance 2 may in this regard be constructed for example such that the temperature and/or the moisture and/or the pH is or are captured as relevant measurable quantity or quantities descriptive of the number of washing operations of the present invention's apparel item 1. In this regard, the number of washing operations of the present invention's apparel item 1 can be realized through appropriate processing of the measurement signals, for which even a previously discussed external processing or evaluation can be carried out on a computer or on a reading instrument for example. For the aforementioned case, the measuring appliance 2 preferably comprises a temperature-sensitive and/or a moisture-sensitive and/or a pH-sensitive sensor 3.

In accordance with a further embodiment particularly preferred according to the present invention, the measuring appliance 2 used for the present invention's apparel item 1 captures the contamination and/or pollution level of the present invention's apparel item 1 via a measurable quantity characteristic for the contamination or pollution level. In accordance with this embodiment, the measuring appliance 2 is preferably such that the radiation and/or the pH and/or the presence of a chemical substance, as of a biological or chemical toxicant or noxiant material, is or are capturable as measurable quantity or quantities. Accordingly, the measuring appliance 2 according to this embodiment preferably comprises a radiation-sensitive and/or a pH-sensitive sensor 3 and/or a sensor 3 having specific sensitivity with regard to a chemical substance, such as a biological toxicant or noxiant material.

In accordance with a further embodiment preferred according to the present invention, the measuring appliance 2 used for the present invention's functional apparel item 1 captures the storage and/or wear time of the present invention's functional apparel item 1 via a measurable quantity characteristic for the storage and/or wear time. The measuring appliance 2 is preferably constructed such in this regard that the temperature and/or the pressure and/or the moisture, in particular the temperature and/or the pressure, is or are capturable as measurable quantity or quantities.

As previously written, the present invention's functional apparel item 1 is preferably accommodated in the storage state in airtight, preferably depressurized secondary packaging. This obviates the possibility that the present invention's functional apparel item 1 may lose its functionability prematurely, in that the present invention's functional apparel item 1 is protected in particular from harmful environmental influences inducing an ageing process, such as high temperatures, moisture, UV radiation, chemical substances and the like. This prevents a premature ageing process, so that the present invention's functional apparel item 1 is preserved so to speak during its storage.

In this context, the measuring appliance 2 used for the present invention's functional apparel item 1 can be constructed such that the time of opening the packaging or secondary packaging or its being damaged is determinable. In this context, the present invention's measuring appliance 2 should capture the temperature and/or the pressure and/or the moisture, in particular the temperature and/or the pressure, as measurable quantity or quantities. In this regard, the measuring appliance 2 should be equipped with a temperature-sensitive and/or a pressure-sensitive and/or a moisture-sensitive sensor 3, in particular with a temperature-sensitive or pressure-sensitive sensor 3.

With regard to the position or fixing of the measuring appliance 2 on the present invention's apparel item 1, the measuring appliance 2 should preferably be disposed on the outside surface of the apparel item 1, i.e. on the side which, in the worn state of the present invention's functional apparel item 1, is remote from the wearer, or on that side of the present invention's functional apparel item 1 that faces the measurable quantity to be captured, so that impeccable capture of the measurable quantities by the measuring appliance 2 is ensured. The measuring appliance 2 may be by way of nonlimiting example sewn onto the present invention's functional apparel item 1. It is similarly possible to secure the measuring appliance 2 to the present invention's functional apparel item 1 by means of a touch and close fastener or connector.

The present invention's functional apparel item 1 as such preferably comprises a sheetlike material, the sheetlike material comprising a layered construction. The layered construction of the sheetlike material may comprise at least one textile fabric and also an adsorptive or adsorbing layer and/or a blocking layer, in particular a membrane.

The textile fabric may be any desired textile material, preferably an air-pervious and/or breathable textile material. Nonlimiting examples are textile wovens, textile knits, textile laids, textile composites, textile nonwovens and the like. The areal weight of the textile fabric may be in the range from 25 to 300 g/m$^2$, in particular in the range from 30 to 200 g/m$^2$ and preferably in the range from 40 to 200 g/m$^2$. The optional adsorptive or adsorbing layer may comprise a material capable of adsorbing a toxicant or noxiant material, such as NBC warfare agents. A useful material for adsorbing poisons or noxiant materials includes in particular activated carbon, preferably in the form of particles of activated carbon or fibers of activated carbon. The adsorbing materials may preferably be fixed on the textile fabric in a manner known per se to one skilled in the art, for example through a continuous or discontinuous application of an adhesive to the textile fabric. The material adsorbing toxicant or noxiant materials may consist for example of discrete particles of activated carbon, preferably in granule form ("granulocarbon") or spherical form ("spherocarbon"). In this case, the average diameter of the particles of activated carbon is less than 1.0 mm, in particular less than 0.5 mm, preferably less than 0.4 mm and more preferably less than 0.3 mm, but generally is at least 0.1 mm. In accordance with this embodiment, the particles of activated carbon are present on the textile fabric in an amount of 5 to 500 g/m$^2$ in particular 10 to 400 g/m$^2$ preferably 20 to 300 g/m$^2$, more preferably 25 to 250 g/m$^2$, even more preferably 50 to 225 g/m$^2$ and most preferably 50 to 200 g/m$^2$. The material capable of adsorbing toxicant or noxiant material can also comprise fibers of activated carbon, in particular in the form of an activated carbon fabric. The areal weight of such activated carbon fabrics may be for example in the range from 20 to 200 g/m$^2$, in particular in the range from 30 to 150 g/m$^2$ and preferably in the range from 50 to 120 g/m$^2$. The activated carbon fabric may comprise for example a woven, loop-formingly knitted, laid or composited fabric of activated carbon, in particular on the basis of carbonized and activated cellulose or of a carbonized and activated acrylonitrile.

The optional blocking layer, in particular membrane, has in particular blocking layer properties with regard to warfare agent or noxiant materials. Useful membrane materials include plastics or polymers, fluorinated polymers, in particular polytetrafluoroethylene, polyurethane, polyethers, polyesters, polyether esters, polyamides, polyimides, polyetheramides, polyetherimides, cellulose and cellulose derivatives.

In accordance with an embodiment particularly preferred according to the present invention, the present invention provides a functional apparel item 1, in particular an NBC protective apparel, such as an NBC protective suit, having a protective function against biological and/or chemical toxicant or noxiant materials, in particular as described above, the present invention's functional apparel item 1 in accordance with this aspect of the present invention being characterized in that it is equipped with at least one sensor 3 for capturing the serviceability of the apparel item 1, in particular by capturing the number of washing operations and/or the wear time and/or the storage time and/or the time after removal of the packaging of the apparel item 1 and/or the contamination or pollution level, in particular with at least one pressure- and/or temperature-sensitive sensor 3, the sensor 3 being part of a measuring appliance 2 integrated in the apparel item 1, measurement signals emittable by the sensor 3 and/or correlating with measurable quantities captured by the sensor 3 being processable, in particular detectable or storable or displayable or emittable, by the measuring appliance 2.

The present invention further provides—in accordance with a further aspect of the present invention—for the use of a measuring appliance 2 (i.e. the method of using a measuring appliance 2), which measuring appliance 2 captures at least one measurable quantity and is in particular conceived as described above, for determining the serviceability of a functional apparel item 1, in particular protective apparel having a protective function against biological and/or chemical toxicant or noxiant materials, wherein the apparel item 1 is equipped with the measuring appliance 2 or the measuring appliance 2 is integrated in the apparel item 1.

For further details regarding the use according to the present invention, reference may be made to the above observations concerning the apparel item of the present invention, which apply to the process of the present invention mutatis mutandis.

The present invention further concerns—in accordance with a further aspect of the present invention—a process for determining the serviceability of a functional apparel item 1 according to the invention, in particular a protective apparel having a protective function against biological or chemical toxicant or noxiant materials. The process of the present invention is characterized in that the apparel item 1 is equipped with at least one measuring appliance 2 capturing measurable quantity and adapted for determining the serviceability of the apparel item 1, or a measuring appliance 2 capturing at least one measurable quantity and adapted for determining the serviceability of the apparel item 1 is integrated in the apparel item 1, and in that a measurable quantity influencing and/or characterizing the serviceability of the apparel item 1, in particular a physical and/or chemical measurable quantity, is captured and/or determined by means of the measuring appliance 2.

For further details regarding the process according to the present invention, reference may be made to the above observations concerning the apparel item of the present invention, which apply to the process of the present invention mutatis mutandis.

The present invention's functional apparel item, the present invention's use of the measuring appliance and also the present invention's process have numerous advantages, of which the following are to be mentioned purely by way of example:

- The use of a specific measuring appliance provides a simple, convenient and inexpensive way of determining the serviceability of the apparel item via the determination of specific measurable quantities, making it possible to make an unambiguous statement with regard to the functionability of the apparel item.
- The present invention's measuring appliance is easy to read out by means of preferably external apparatus, so that determination of the serviceability of the present invention's functional apparel item is possible even under adverse conditions, for example in the course of a military deployment in the field.
- The specific determination of the serviceability of the present invention's functional apparel item makes it possible to ensure at all times a high protective potential for the wearer of the present invention's functional apparel item.
- In addition, the optimized determination of the serviceability of the present invention's apparel item makes it possible to optimize the wear or use duration, so that the present invention's apparel item can be optimally utilized, which leads to a distinct reduction in costs.
- The individually adaptable equipment of the measuring appliance with specific sensors makes it possible to adapt the measuring appliance to individual needs, so that specific measurable quantities can be captured in a specific manner. This makes it possible to capture a wide gamut of factors, including environmental factors, influencing the serviceability of the present invention's functional apparel item.

Further refinements, modifications and variations of the present invention will become apparent to and realizable by the ordinary skilled on reading the description without their having to depart from the realm of the present invention.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A functional NBC protective apparel item having a protective function against biological and chemical toxicant or noxiant materials, wherein the garment is accommodated in the storage state in air-tight, depressurized packaging, wherein the garment comprises a sheetlike material having a layered construction, the layered construction comprising at least one textile sheetlike construction and an adsorptive or adsorbing layer as well as, a barrier layer in the form of a membrane, and wherein the garment is equipped with a measuring appliance capturing the storage time of the apparel item via at least one measurable parameter being characterized for the storage time, and being at least one of temperature, pressure or moisture, wherein the measuring appliance is adapted for determining the serviceability of the garment and comprises an electrical or electronic sensor selected from the group consisting of a temperature-sensor, a pressure-sensor and a moisture sensor, the sensor transforming a measurable parameter into an electrical, readable correlated measurement signal wherein the measurable parameter is capturable in relation to at least one of their duration, intensity and frequency.

2. The functional NBC protective garment according to claim 1, wherein the sensor is selected from the group consisting of a thermistor or posistor temperature-sensor; a barometric pressure-sensor, a ceramic pressure-sensor and a silicon-based pressure-sensor; and a moisture-sensor having moisture content dependent sensitivity or conductivity.

3. The functional NBC protective garment according to claim 1, wherein the sensor is a physical, chemical or biochemical sensor, the sensor responding to the capture of a measurable parameter by inducing or exhibiting a measurement signal induced by a physical, chemical or biochemical reaction.

4. The functional NBC protective garment according to claim 1, wherein the measuring appliance comprises a storage unit for electronic storage of a measurement signal correlating with a measurable parameter, the storage unit being coupled with the sensor electrically.

5. The functional NBC protective garment according to claim 1, wherein the measuring appliance comprises an electronic circuit for processing a measurement signal correlating with a captured measurable parameter or for coupling the sensor with a storage unit.

6. The functional NBC protective garment according to claim 5, wherein the electronic circuit is coupled with at least one of a sensor, a storage unit and an electronic circuit.

7. The functional NBC protective garment according to claim 5, wherein the electronic circuit reads out a processed or unprocessed measurement signal stored in a storage unit and correlating with a measurable parameter.

8. The functional NBC protective garment according to claim 1, wherein the measuring appliance comprises a read-out unit, the read-out unit being electrically coupled with at least on of a sensor, a storage unit and an electronic circuit, wherein the read-out unit provides in readable form the measurement signal correlating with a measurable parameter.

9. The functional NBC garment item according to claim 1, wherein the measuring appliance comprises an energy source.

* * * * *